United States Patent [19]

Insley et al.

[11] Patent Number: 5,029,699

[45] Date of Patent: Jul. 9, 1991

[54] IMPACT RESISTANT CONTAINER FOR HAZARDOUS MATERIALS

[75] Inventors: Thomas I. Insley, Lake Elmo; Laurel A. Alvarez, St. Paul, both of Minn.

[73] Assignee: Minnesota Mining and Manufacturing Company, St. Paul, Minn.

[21] Appl. No.: 564,888

[22] Filed: Aug. 9, 1990

[51] Int. Cl.[5] ..... B65D 81/26

[52] U.S. Cl. ..... 206/204; 206/524.5; 206/594

[58] Field of Search ..... 206/523, 591, 594, 204, 206/524.5

[56] References Cited

U.S. PATENT DOCUMENTS

| | | | |
|---|---|---|---|
| 3,621,994 | 11/1971 | Brown | 206/65 R |
| 3,971,373 | 7/1976 | Braun | 128/146.2 |
| 3,999,653 | 12/1976 | Haigh et al. | 206/584 |
| 4,100,324 | 7/1973 | Anderson et al. | 428/288 |
| 4,118,531 | 10/1978 | Hauser | 428/224 |
| 4,240,547 | 12/1980 | Taylor | 206/204 |
| 4,429,001 | 1/1984 | Kolpin et al. | 428/283 |
| 4,560,069 | 12/1985 | Simon | 206/591 |
| 4,573,578 | 3/1986 | Greminger et al. | 206/524 |
| 4,756,937 | 7/1988 | Mentzer | 428/35 |
| 4,813,948 | 3/1989 | Insley | 604/366 |
| 4,933,229 | 6/1990 | Insley et al. | 428/224 |
| 4,972,945 | 11/1990 | Insley et al. | 206/524.5 X |

FOREIGN PATENT DOCUMENTS

| | | | |
|---|---|---|---|
| 2173174 | 10/1986 | United Kingdom | 206/523 |

OTHER PUBLICATIONS

U.S. patent application Ser. No. 593,308 filed Apr. 4, 1989 by Insley.

*Primary Examiner*—William I. Price

*Attorney, Agent, or Firm*—Gary L. Griswold; Walter N. Kirn; Robert W. Sprague

[57] ABSTRACT

A container has a self-sustaining housing filled with a first sorbent body of compressed polyolefin microfibers, which body is formed with at least one pocket that snugly receives a vessel holding hazardous materials. The container is closed by a lid which is filled with a second sorbent body of compressed polyolefin microfibers, and when the lid is in place, the second body presses against the vessel to hold it snugly in place. At least a portion of the first sorbent body has a solidity of less than 20%, making it highly sorbent of liquids so that it can sorb any liquid that might leak from the vessel and thus help to prevent the liquid from escaping from the container.

18 Claims, 2 Drawing Sheets

IMPACT RESISTANT CONTAINER FOR HAZARDOUS MATERIALS

BACKGROUND OF THE INVENTION

1. Field of the Invention

The present invention relates to a container which is useful for shipping and storing hazardous liquids and other hazardous materials.

2. Background Information

Containers currently employed for transporting and storing hazardous liquids often have a cushioned pocket for each of one or more vessels that may be breakable, e.g., glass bottles. The container of coassigned U.S. Pat. No. 4,884,684 (Bernardin et al.) has a housing containing a resilient energy-absorbent cushion of aqueous fluid sorbent material that is formed with a plurality of pockets. Each pocket can receive a vial of hazardous or biological material. In the illustrated containers, the cushions may be sheets of nonwoven, fibrous polyolefinic (e.g., polypropylene) material such as disclosed in coassigned U.S. Pat. No. 4,118,531 (Hauser) and/or such as the universal sorbent sold under the trademark POWERSORB by Minnesota Mining and Manufacturing Co. One or more of the sheets are formed with openings for receiving the vials, and additional sheets that have no such openings cover those openings to complete the cushion which may have a percentage void volume available for sorbing aqueous fluid of between approximately 50 and 95 percent (which corresponds to a solidity between approximately 50 and 5 percent).

The container of U.S. Pat. No. 4,240,547 (Taylor) has tubular cavities for a number of test tubes and is formed with a central recess through which any leaking liquid should flow and an absorbent material filling that recess, the purpose of which is to absorb leaking liquid before it can escape from the container. Another multipocket design is shown in U.S. Pat. No. 3,621,994 (Brown). Some such containers have a single pocket that may contain sorptive material to prevent any leaking liquid from escaping from the container. See U.S. Pats. No. 3,999,653 (Haigh et al.); 4,560,069 (Simon); 4,573,578 (Greminger et al.); and 4,756,937 (Mentzer). The material of which the Mentzer container is made entraps "an antidote" with which leaking liquid can react to produce a gel. A large number of other containers are known that have one or more cushioned pockets for transporting liquid-filled vessels.

SUMMARY OF THE INVENTION

The invention provides a container in which breakable vessels holding hazardous liquids or other hazardous materials can be economically and safely shipped and stored. The term "hazardous" can be applied to any material which might damage the environment, whether or not the material is classified as hazardous.

Briefly, the container of the invention comprises a sorbent body formed with at least one pocket for receiving a vessel, which sorbent body comprises compressed particles of polyolefin microfibers and has a solidity of at least 10%, and at least a portion of the sorbent body has a solidity of from 10 to 20%, a self-sustaining housing encompassing the sorbent body and formed with an opening through which said vessel can be introduced and removed from said pocket, and a removable lid that closes the opening. The term "particles of polyolefin microfibers" includes 1) microwebs produced by divellicating a polyolefin microfiber web as disclosed in coassigned U.S. Pat. No. 4,813,948 (Insley), which is incorporated herein by reference,
2) particles obtained by hammermilling a polyolefin microfiber web, and
3) flash spun polyolefin microfibers, such as Tywick ® hazardous material pulp available from New Pig Corp., Altoona, Pa. which have a diameter of about 1 to 5 μm and an average particle length of 1 to 6 mm.

The best sorbency for a given solidity is obtained when those particles are polyolefin microfiber microwebs.

Compression of polyolefin microfibers can be accomplished at ambient temperatures using conventional compression molding equipment such as flash molding or powder molding equipment. Generally, a pressure of about 0.5 MPa is sufficient to achieve a solidity of 10%. At solidities of substantially less than 10%, the sorbent body 1) has insufficient integrity to remain intact while being handled or shipped, both before use and while being used to transport vessels of hazardous materials,
2) distorts under the weight of a liquid-containing vessel that has been fitted into a pocket, and
3) shrinks when saturated with liquid.

On the other hand, when such a sorbent body has a solidity of at least 12% (more preferably at least 15%), it tends to maintain its original dimensions in use even when saturated with liquid, so that each of its pockets prevents a fitted vessel from moving about within the pocket during shipment.

The solidity of the sorbent body is calculated according to the formula $$\% \text{ solidity} = \frac{\text{density of sorbent body}}{\Sigma\,(\text{comp. dens.} \times \text{wt. fract. of comp.})} \times 100$$

where "comp. dens." is the density of an individual component present in the sorbent body and "wt. fract. of comp." is the corresponding weight fraction of the component. While greater sorbency is achieved at lower solidities, a sorbent body of higher solidity has greater coherency.

When the polyolefin microfibers of the sorbent body are microfiber microwebs, pressures in the range of about 0.7 to 2.0 MPa should be sufficient to produce sorbent bodies in the solidity range of about 12 to 20%. At such pressures, sorbent bodies of good integrity are obtained with no significant reduction in the available microfiber surface area.

The entire sorbent body within the housing can have a solidity of less than 20%. However, the vessel is better protected from shocks during shipment and handling when at least part of the sorbent body has a higher solidity. Sorbent bodies having higher solidities have better coherency and consequently can tolerate more abuse than sorbent bodies of lower solidity, while sorbent bodies of lower solidities have a greater sorbency capacity per unit volume. Hence, the selection of the solidity of the sorbent body reflects a compromise between the resistance to compression under expected loads, sorbency requirements, and integrity or strength requirements.

While the sorbent body of the containers of the present invention may have a uniform solidity throughout its entire cross-section, the sorbent capacity and shock protection properties provided by the container are maximized when compressed polyolefin microfiber materials of different solidity levels are used for various portions of the sorbent body. In a preferred container, a lower solidity material is used for the "bottom" of the sorbent body to provide a greater sorbent capacity while higher solidity materials are used in the side wall and top portions to provide better shock protection. Compressed polyolefin microfiber materials having solidities between 10–20% are preferred for the lower solidity "sorbent portions" of the sorbent body while compressed polyolefin microfiber materials having solidities between 30–70% are preferred for the side wall and top portions of the body where it is desirable to provide better shock protection. By the "bottom" of the housing is meant the portion of the housing that is most remote from the lip of the housing. The bottom preferably is broad and flat to afford stability during storage and shipment.

The solidity of a portion of the sorbent body within the housing can be greater than 80%. Excellent cushioning is provided at 30 to 70%, more preferably from 40 to 50%.

When the sorbent body at the wall of a pocket has a solidity of less than 30%, the pocket should be lined with a porous sleeve. The sleeve can be a molded article or a web of thermoplastic fibers such as spun-bonded polypropylene scrim. When the sleeve is a molded article, it can be formed by an injection molding process.

The housing and the lid of the novel container preferably comprise a high-impact, thermoplastic resin that is chemically resistant to aggressive chemicals, has good stress crack resistance, and retains good toughness at temperatures as low as −35° C. Preferred thermoplastic resins having these properties are polyethylene and polypropylene. For greater strength, the resin can be filled with reinforcing materials such as glass fibers or the housing and cover can comprise metal. Preferably, the lid provides a fluid-tight closure to provide a double-assurance that any leaking liquid does not escape.

The underside of the lid preferably bears a second sorbent body of compressed polyolefin microfibers. The second sorbent body can have a solidity from 30–70%, but preferably between 40–50% to afford better shock protection to vessels to be transported in the container.

A prefered container of the present invention has a preformed, self-sustaining housing and a collar having an opening through which one or more vessels may be placed into or removed from the container. The lower portion of the container can readily be made by injection molding or blow molding techniques. The collar preferably is made by injection molding. The containers can be made from a variety of polymeric resins, but they preferably are made from polyethylene or polypropylene which produce tough, chemically resistant containers.

As taught in the above-cited Insley U.S. Pat. No. 4,813,948, particles of polyolefin microfibers from which the sorbent body is made can be loaded with particulate material. The particulate material can be a sorbent-type material or a material selected to neutralize potentially hazardous liquids. For example, see coassigned U.S. Pat. No. 3,971,373 (Braun), U.S. Pat. No. 4,100,324 (Anderson et al.) and U.S. Pat. No. 4,429,001 (Kolpin et al.), which are incorporated herein by reference.

Containers of the present invention are particularly useful for the transportation and storage of quantities of hazardous materials up to about 10 liters in volume.

DESCRIPTION OF THE PREFERRED EMBODIMENTS

Figure 1:
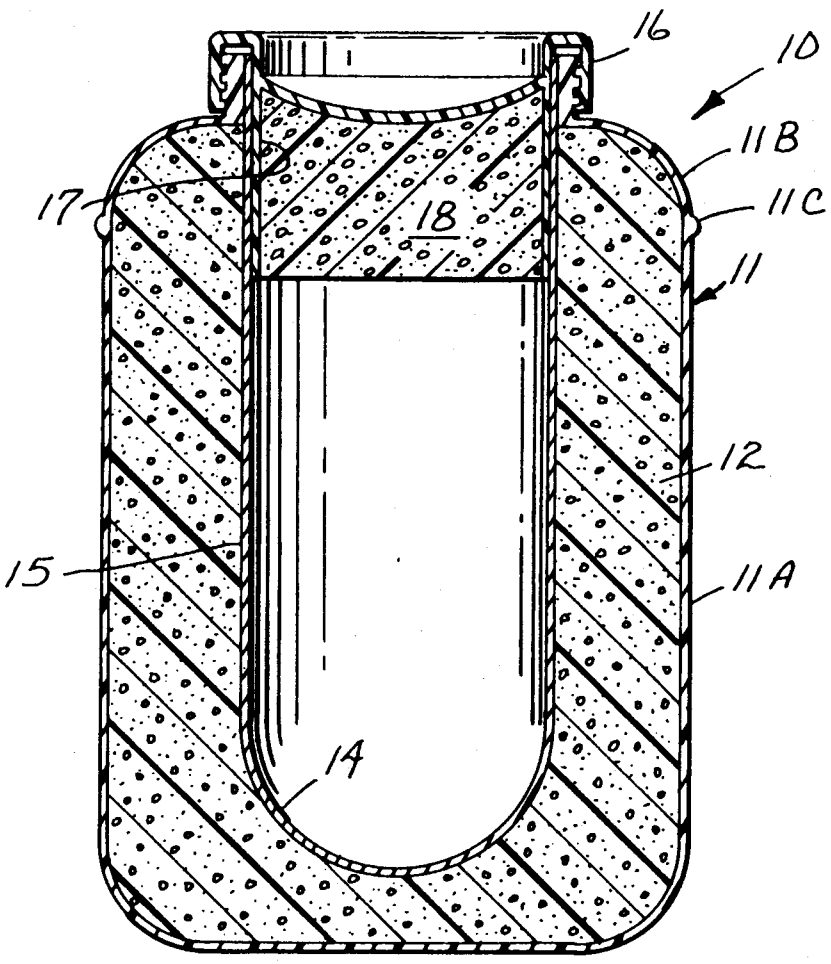
FIG. 1 is a central cross section through a first container of the invention.

FIG. 1 shows a preferred novel container 10 which has a self-sustaining, substantially cylindrical housing 11 of a tough, thermoplastic resin such as polyethylene. The housing contains polyolefin microfibers that, after being inserted into the housing, were compressed to form a sorbent body 12 having a cylindrical central pocket 14 that is lined with a porous sleeve 15, which sorbent body has solidity within the range of 10–20%. The sleeve 15 helps the sorbent body 12 to keep its shape, especially while a cylindrical vessel for hazardous material (not shown) is being fitted into the pocket.

To form the sorbent body 12, a cylindrical shell 11A which is closed at one end is snugly inserted into a hollow cylinder, and a cylindrical mandrel bearing the sleeve 15 is positioned within the shell, leaving a cavity between the sleeve and the wall of the shell. The cavity then is filled with particles of polyolefin microfibers, and an annular ram compresses the microfibers to form the sorbent body 12. The ram is removed, leaving the sleeve 15 as shown in FIG. 1. After removing the cylindrical shell 11A from the hollow cylinder, a collar 11B is sealed to the shell along a thermal-mechanical (e.g., an ultrasonic weld) weld line 11C to complete the housing 11.

A self-sustaining, substantially cylindrical lid 16 of a tough thermoplastic resin has a cylindrical projection 17 that snugly fits into the top of the lined pocket 14. The cylindrical projection is filled with a second sorbent body 18 of compressed polyolefin microfibers, preferably having a solidity of at least 40%. The second sorbent body contacts the top of a vessel (not shown) when the lid 16 is screwed onto the housing 11, thus holding the vessel snugly in the pocket and cushioning it against shock during handling and shipment.

Figure 2:
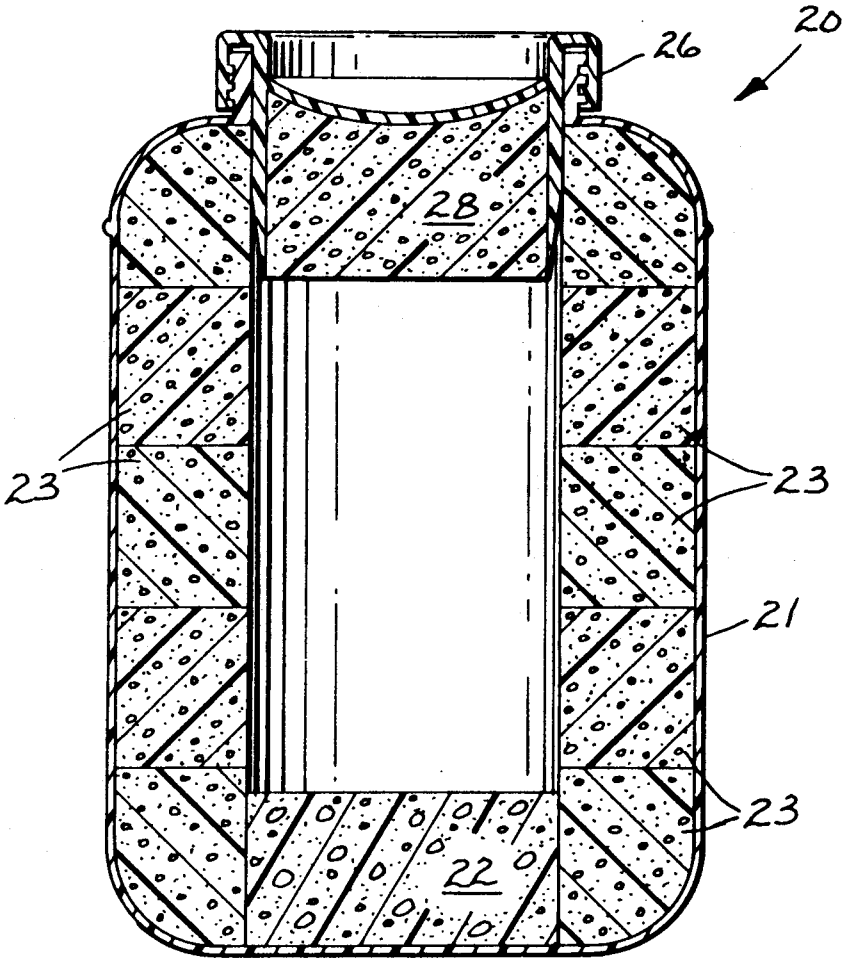
FIG. 2 is a central cross section through a second container of the invention.

FIG. 2 shows a container 20 of the invention which has a self-sustaining, substantially cylindrical housing 21 of a tough thermoplastic resin that is lined with a sorbent body of compressed polyolefin microfibers. A portion of the sorbent body resting on the bottom of the housing is a cylinder 22 having a solidity within the range of 10–20%. The remainder of the sorbent body lining the housing consists of several rings 23 that can have a solidity up to or even greater than 80%, preferably within the range of 40–50% The rings 23 and cylinder 22 together form a pocket into which a cylindrical vessel for hazardous material (not shown) can be fitted. When the solidity of the rings is at least 30%, the sorbent body has sufficient integrity and rigidity that a porous sleeve should not be required.

A cylindrical lid 26 contains a second sorbent body 28 and can be identical in construction to the lid 16 of FIG. 1. When the lid 26 is screwed onto the housing 21, its second sorbent body 28 can cushion said vessel against shock.

Figure 3:
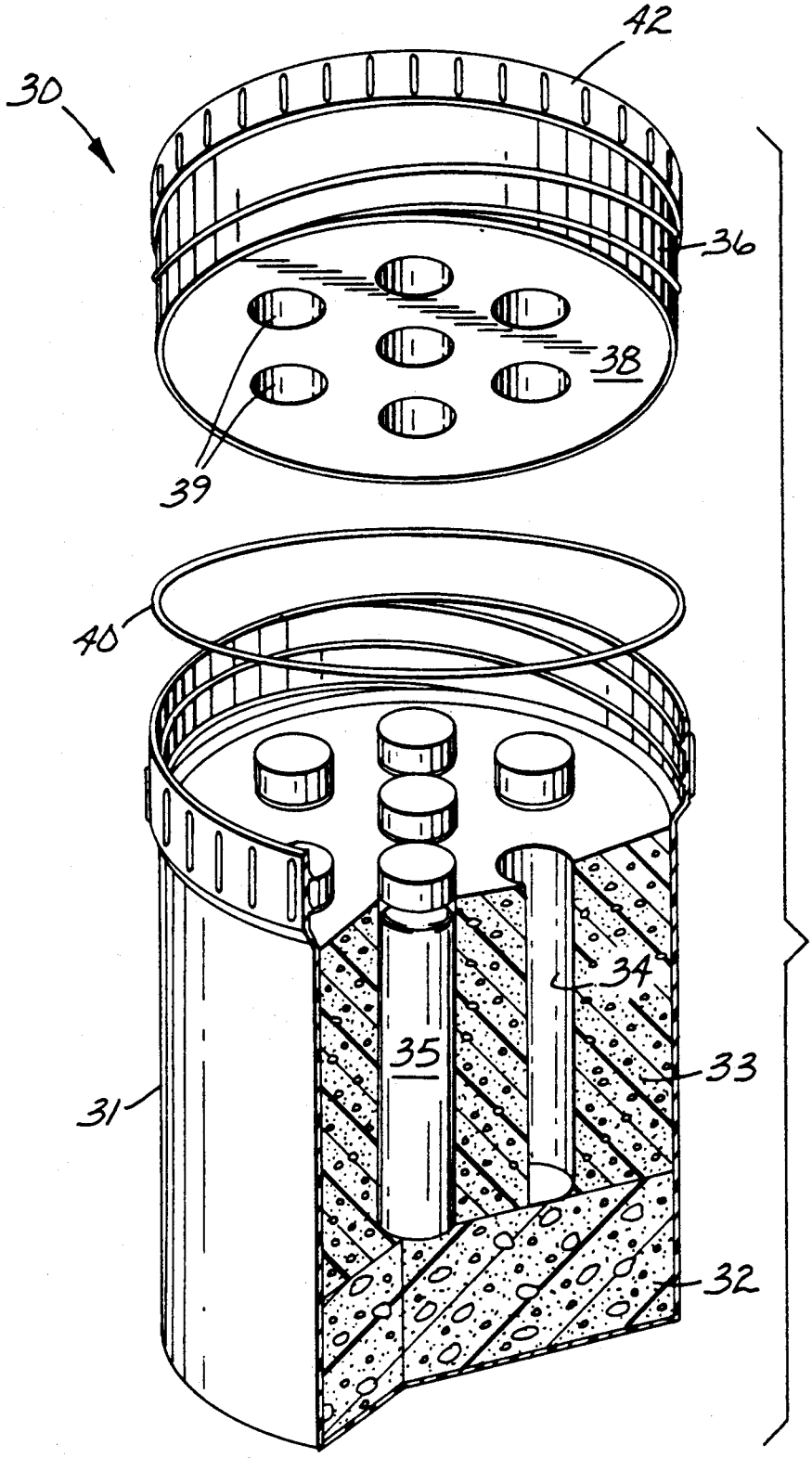
FIG. 3 is an exploded perspective view of a third container of the present invention, partly broken away to show details.

FIG. 3 shows a container 30 adapted for shipment of vials 35 of hazardous liquid material. The container has a self-sustaining, substantially cylindrical housing 31 that is lined with a sorbent body of compressed polyolefin microfibers. A portion of the sorbent body is a first cylinder 32 covering the bottom of the housing having a solidity of less than 20%. The remainder of the sorbent body is a second cylinder 33 that has a solidity in the range of 30–70% (preferably 40–50%) and is formed with seven pockets 34, each of which can snugly receive one vial 35 that projects beyond the exposed face of the cylinder 33. A self-sustaining, substantially cylindrical lid 36 is filled with a second sorbent body 38 of compressed polyolefin microfibers preferably having a solidity of at least 40%. The second sorbent body 38 is formed with cavities 39 into which the protruding portions of the vials 35 fit snugly. At the base of each cavity 39, the second sorbent body 38 contacts the top of a nested vial 35 when the lid 36 is screwed onto the housing 31. The sorbent body should fit snugly but still be able to turn inside the lid 36 as it is tightened. Upon doing so, a ratcheting cap 42 on the lid ensures the correct tightness, and an elastomeric O-ring 40 ensures a liquid-tight seal.

teeth/cm$^2$ and a speed of 1200 rpm to produce "Microfiber Microwebs A" having an average nuclei diameter of 0.5 mm, an average microweb diameter of 1.3 mm, and a solidity of about 2%.

Example 1

A container of the invention as illustrated in FIG. 1 is produced by compressing "Microfiber Microwebs A" into a sorbent body having a solidity of approximately 17%. Assembly of the container is completed by fusing the collar to the lower portion of the housing using a hot plate fusing technique. The cap assembly is prepared by placing loose "Microfiber Microwebs A" into the cap cavity and compressing the loose mass into a body having a solidity of approximately 50%. The cap can be fitted with an O-ring to provide a liquid tight seal between the cap and the container.

Examples 2–11

100 g of "Microfiber Microwebs A" were placed in a 14.5 cm diameter (ID) cylindrical mold and compressed under the indicated pressure to produce a plug having the thickness as shown in Table I. After removal from the mold, the sorbency of each plug was determined using the previously described Sorbency Test, with results shown in Table I.

TABLE I

| Example | Compressed Thickness (cm) | Applied Press. (MPa) | Recovered Thickness (cm) | Sat. Weight | Solidity | Sorbency |
|---|---|---|---|---|---|---|
| 2 | 5.0 | NA | 9.0 | 1045 | 8 | 9.5 |
| 3 | 3.0 | NA | 7.3 | 980 | 10 | 8.8 |
| 4 | 3.5 | NA | 7.2 | 970 | 10 | 8.7 |
| 5 | 2.0 | 0.70 | 5.3 | 845 | 13 | 7.5 |
| 6 | 1.8 | 0.98 | 4.0 | 670 | 17 | 5.7 |
| 7 | 1.7 | 0.88 | 4.0 | 690 | 17 | 5.9 |
| 8 | 1.8 | 0.88 | 4.0 | 705 | 17 | 6.1 |
| 9 | 1.5 | 1.40 | 3.2 | 570 | 22 | 4.7 |
| 10 | 1.4 | 1.75 | 2.9 | 490 | 24 | 3.9 |
| 11 | 2.0 | 0.70 | 5.7 | NA | 12 | NA |
| 12 | 1.8 | 1.05 | 4.0 | NA | 17 | NA |

TEST PROCEDURE

Sorbency

A plug of molded microweb material, 100 grams in weight, 14.5 cm in diameter, and having the indicated solidity, is placed in a container of water and allowed to soak for 15 minutes. The sample is then removed and allowed to drain for 15 minutes, and the sorbency of the plug is determined by weight differential. "Sorbency" is reported in grams of liquid retained per gram of absorbent.

Microfiber Source Web

A polypropylene blown microfiber (BMF) source web was prepared according to coassigned U.S. Pat. No. 4,933,229 (Insley et al.) which is incorporated herein by reference. The resulting "Microfiber Source Web" had an average fiber diameter of 6–8 μm (effective), a basis weight of 270 g/m$^2$, a solidity of 5.75%, and contained 8% by weight "Triton X-100", a poly(ethylene oxide) based nonionic surfactant available from Rohm and Haas Corp.

Microfiber Microwebs A

The "Microfiber Source Web" was divellicated as described in the above-cited Insley U.S. Pat. No. 4,813,948 using a lickerin having a tooth density of 6.2

The data of Table I demonstrates a direct correlation between the sorbency of the compressed plugs and their solidity, namely, the lower the solidity, the higher the sorbency.

What is claimed is:

1. A container suitable for transporting vessels for hazardous materials, said container comprising a sorbent body formed with at least one pocket for receiving a vessel, which sorbent body comprises compressed particles of polyolefin microfibers and has a solidity of at least 10%, and at least a portion of the sorbent body has a solidity of from 10 to 20%, a self-sustaining housing encompassing the sorbent body and formed with an opening through which a said vessel can be introduced into and removed from said pocket, and a removable lid that closes the opening.

2. A container as defined in claim 1 wherein said particles of polyolefin microfibers comprise microwebs.

3. A container as defined in claim 1 wherein the sorbent body is loaded with solid sorbent-type particulate material.

4. A container as defined in claim 1 wherein said sorbent body is loaded with material selected to neutralize potentially hazardous liquids.

5. A container as defined in claim 1 wherein said housing and lid comprise high-impact thermoplastic resin that is chemically resistant, has good stress crack resistance, and retains good toughness at temperatures as low as −35° C.

6. A container as defined in claim 5 wherein said housing and lid are polyethylene.

7. A container as defined in claim 1 wherein each pocket is lined with a tough, porous sleeve.

8. A container as defined in claim 1 wherein the sorbent body has a solidity of at least 12%.

9. A container as defined in claim 1 wherein the lid is filled with a second sorbent body which comprises compressed polyolefin microfibers and contacts a stored vessel when the lid is in place.

10. A container as defined in claim 9 wherein the first-mentioned porous body is formed with a single cylindrical pocket, and the lid is formed with a cylindrical projection that fits into the pocket when the lid is in place.

11. A container as defined in claim 9 wherein the second sorbent body is formed with a cavity that extends said pocket when the lid is in place.

12. A container suitable for transporting vessels for hazardous materials, said container comprising a sorbent body formed with at least one pocket for receiving a vessel, which sorbent body comprises compressed particles of polyolefin microfibers and has a solidity of from 10% to 20%.

a self-sustaining housing comprising a cylindrical shell which is closed at one end and a collar that closes the other end of the shell, which shell and collar together encompass the sorbent body, the collar being formed with an opening through which a said vessel can be introduced into and removed from the pocket, and a removable lid that closes the opening in the collar.

13. A container as defined in claim 12 wherein the collar is sealed to the shell along a thermal-mechanical weld line.

14. A container suitable for transporting vessels for hazardous materials, said container comprising a sorbent body comprising compressed particles of polyolefin microfibers, has a solidity of from 10 to 20%, and a second portion of which has a solidity of at least 30% and is formed with a plurality of pockets, each of which can receive a vessel, a self-sustaining substantially cylindrical housing encompassing the sorbent body, which housing is closed at one end and formed at its other end with an opening through which said vessels can be introduced and removed from said pockets, and a removable lid that closes the opening.

15. A container as defined in claim 14 wherein the first portion of the sorbent body is a first cylinder covering the closed end of the housing, the second portion is a second cylinder, and said pockets extend through the ends of the second cylinder.

16. A container as defined in claim 14 wherein the lid contains a second sorbent body formed with a cavity aligned with each of said pockets.

17. A container as defined in claim 16 wherein the housing and lid are formed with mating threads.

18. A container as defined in claim 17 wherein the lid has a ratcheting cap to ensure correct tightness.

* * * * *